US009215899B1

(12) United States Patent
Aronson

(10) Patent No.: US 9,215,899 B1
(45) Date of Patent: Dec. 22, 2015

(54) POCKET T-SHIRT WITH A POCKET MADE OUT OF NECKTIE MATERIAL

(71) Applicant: Matthew David Aronson, Greensboro, NC (US)

(72) Inventor: Matthew David Aronson, Greensboro, NC (US)

( * ) Notice: Subject to any disclaimer, the term of this patent is extended or adjusted under 35 U.S.C. 154(b) by 0 days.

(21) Appl. No.: 14/495,011

(22) Filed: Sep. 24, 2014

Related U.S. Application Data

(60) Provisional application No. 61/882,284, filed on Sep. 25, 2013.

(51) Int. Cl.
*A41D 27/20* (2006.01)
*A41B 1/08* (2006.01)
*A41D 25/00* (2006.01)

(52) U.S. Cl.
CPC . *A41D 27/20* (2013.01); *A41B 1/08* (2013.01); *A41D 25/00* (2013.01)

(58) Field of Classification Search
CPC ..... A41D 27/20
USPC ..... 2/69, 113, 114, 115, 247, 126, 249
See application file for complete search history.

(56) References Cited

U.S. PATENT DOCUMENTS

| | | | | |
|---|---|---|---|---|
| 4,656,673 | A * | 4/1987 | Easton et al. | 2/47 |
| 5,588,154 | A * | 12/1996 | Blauer et al. | 2/69 |
| 5,903,928 | A * | 5/1999 | Hyung-Seob | 2/244 |
| 6,038,698 | A * | 3/2000 | Lawler | 2/69 |
| 7,291,015 | B2 * | 11/2007 | Duprey | 434/132 |
| D596,829 | S * | 7/2009 | Miller | D2/717 |
| 8,335,724 | B2 * | 12/2012 | Sipes et al. | 705/26.1 |

* cited by examiner

*Primary Examiner* — Tejash Patel
(74) *Attorney, Agent, or Firm* — Blake P. Hurt; Tuggle Duggins P.A.

(57) ABSTRACT

A pocket t-shirt with a pocket formed from a first material such as that of a necktie, affixed to the upper left portion of a shirt formed from a second material, different from the first, is provided. The shirt may be one of a variety of colors, and the pocket material may define a multitude of patterns and colors as well. The V-shaped pocket will be sewn onto the shirt to introduce an element of class to the casual look of the t-shirt. A method of forming a pocket t-shirt is also provided.

3 Claims, 3 Drawing Sheets

POCKET T-SHIRT WITH A POCKET MADE OUT OF NECKTIE MATERIAL

This non-provisional patent application claims all benefits under 35 U.S.C. §119(e) of U.S. provisional patent application Ser. No. 61/882,284 filed 25 Sep. 2013, entitled "Pocket T-shirt with Pocket Made Out of Necktie Material", in the United States Patent and Trademark Office, which is incorporated by reference in its entirety herein.

FIELD OF THE INVENTION

The invention herein pertains to pocket t-shirts and particularly pertains to pocket t-shirts with triangular shaped pockets formed out of necktie material.

DESCRIPTION OF THE PRIOR ART AND OBJECTIONS OF THE INVENTION

Currently there are a number of pocket t-shirt styles available on the market. The existing manufacturers of these shirts attract customers by portraying a more, upscale, "preppy" brand and image while providing a more relaxed, casual look. While these companies aim for customers in the higher-class, more luxury casual market, the conventional designs fall short in the potential for bringing class to the casual wear of t-shirts. Further, the conventional pocket t-shirt is a solid color or white affair with little opportunity for personality and personal style.

Thus, in view of the problems and disadvantages associated with prior art t-shirt designs, the present invention was conceived and one of its objectives is to provide a pocket t-shirt with a pocket formed from a stylish material different from that forming the t-shirt body.

It is another objective of the present invention to provide a t-shirt combining the class of formal wear in the form of a necktie with the casual clothing style of a t-shirt.

It is still another objective of the present invention to provide a classy pocket t-shirt with a triangular shaped pocket formed from necktie material, such as polyester, silk, microfiber, or bamboo.

It is yet another objective of the present invention to provide a pocket t-shirt with a pocket formed from the V-shaped end of a necktie.

It is a further objective of the present invention to provide a pocket t-shirt that is efficient and easy to manufacture.

It is still a further objective of the present invention to provide a pocket t-shirt with a V-shaped pocket formed from necktie material on the upper left breast portion of the shirt.

It is yet a further objective of the present invention to provide a pocket t-shirt defining a variety of shirt colors with a pocket formed from a plurality of necktie patterns.

Various other objectives and advantages of the present invention will become apparent to those skilled in the art as a more detailed description is set forth below.

SUMMARY OF THE INVENTION

The aforesaid and other objectives are realized by providing a pocket t-shirt with a pocket formed from necktie material positioned on the upper left breast of the shirt which provides a new, classy design for pocket t-shirts. The pocket is of standard size with a V-shape at the bottom and is affixed to the shirt by standard means such as by sewing, adhesives, or the like.

DETAILED DESCRIPTION OF THE PREFERRED EMBODIMENT AND OPERATION OF THE INVENTION

Figure 1:
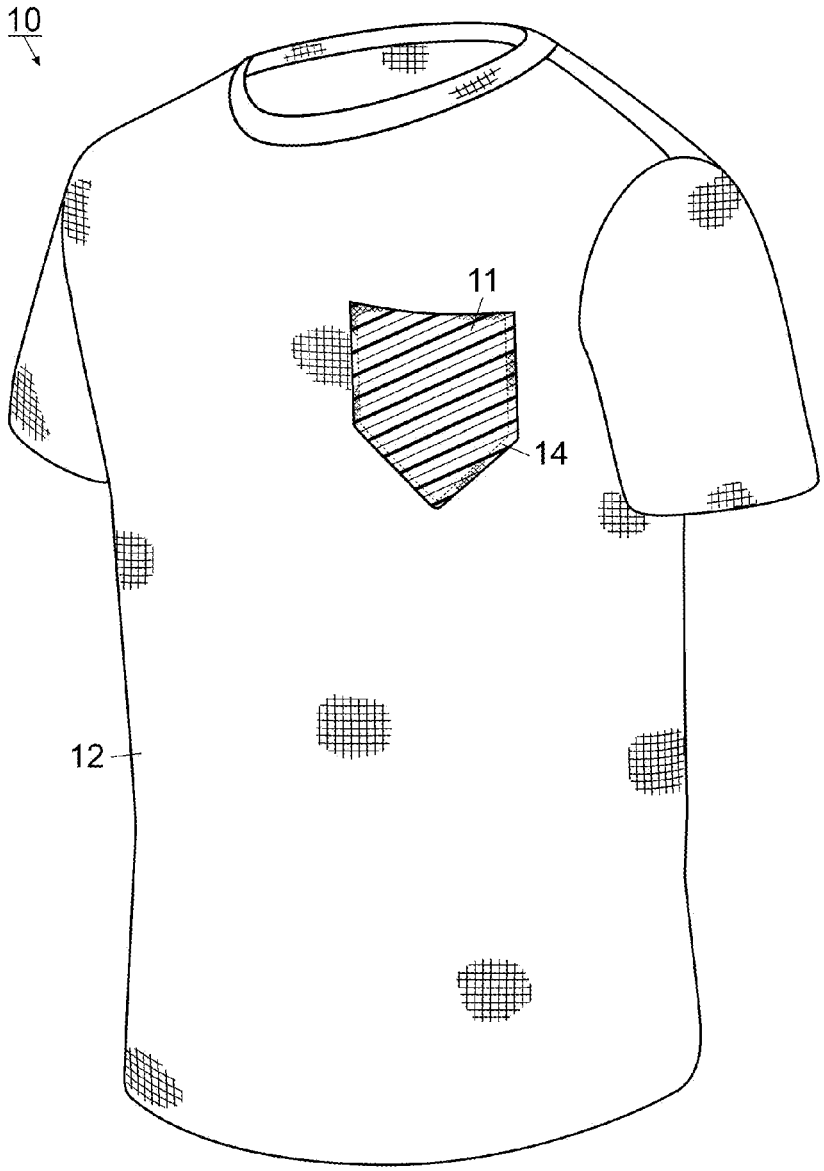
FIG. 1 shows a side perspective view of a pocket t-shirt with necktie pocket.
Figure 2:
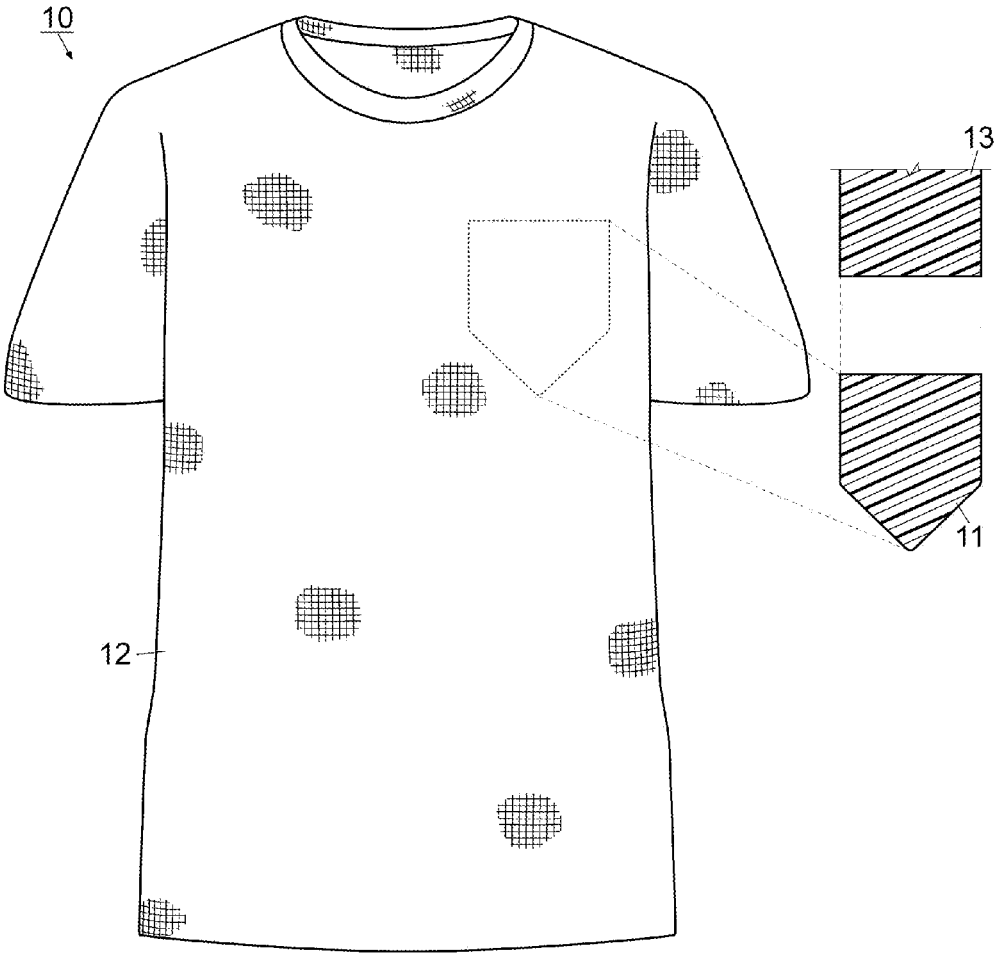
FIG. 2 pictures the t-shirt of FIG. 1 with the necktie pocket exploded therefrom.
Figure 3:
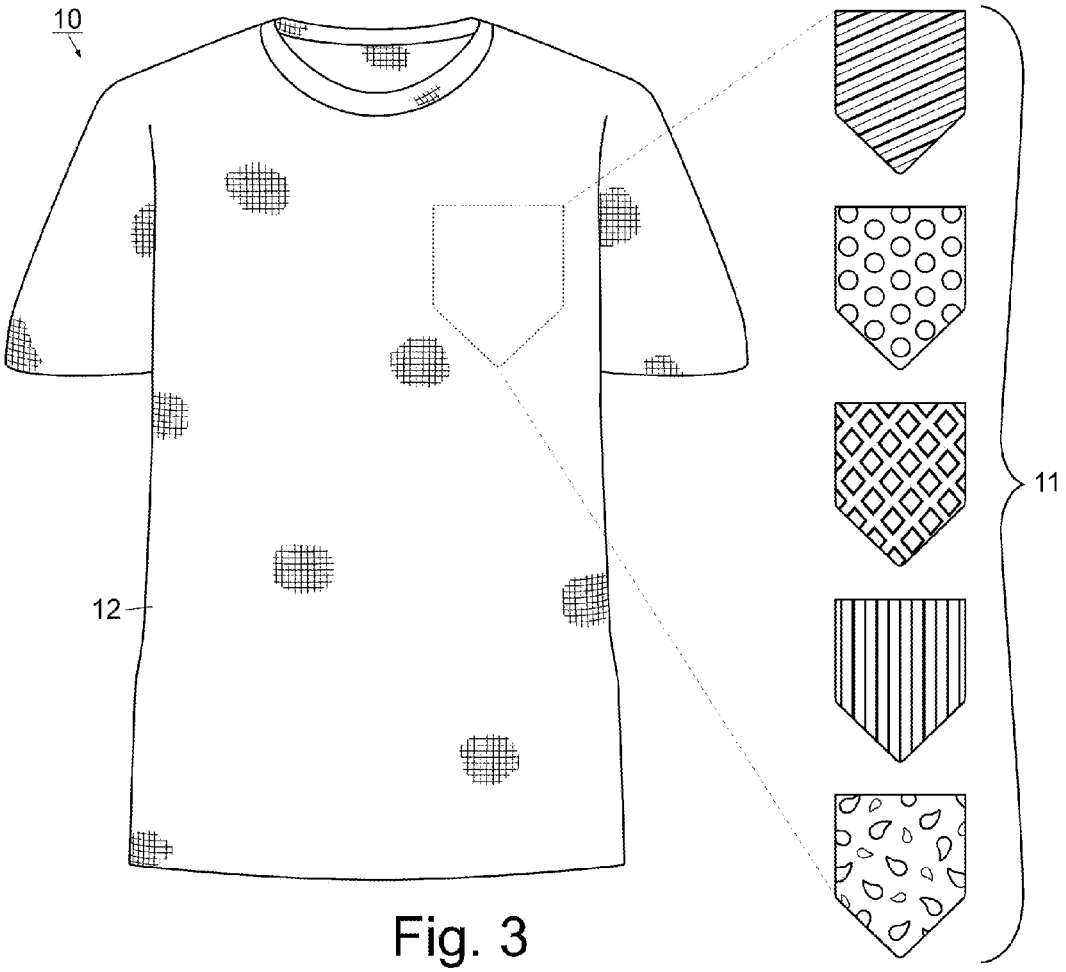
FIG. 3 depicts the pocket t-shirt of FIG. 1 with a variety of pocket patterns.

For a better understanding of the invention and its operation, turning now to the drawings, FIGS. 1-3 show pocket t-shirt 10 including tie pocket 11 affixed to shirt 12, such as by sewing, as is conventional, as seen by stitching 14. Although shirt 12 is preferably represented in FIGS. 1-3 as a t-shirt, it should be understood that shirt 12 may also encompass long-sleeved t-shirts, front buttoned short-sleeved collared shirts (colloquially referred to as Polo™ shirts), oxford shirts, vests, sweaters, sweatshirts, jacket, and the like. While preferred shirt 12 is formed from a first material such as cotton, is should be understood that shirt 12 may also be formed from blended cotton (for example ninety percent (90%) cotton, ten percent (10%) polyester), polyester, microfiber, wool, or other suitable materials as are known in the clothing arts. Tie pocket 11 is preferably formed from silk, although pocket 11 may also be formed from polyester, composite or synthetic silk, wool, acetate, rayon, microfiber, linen, or other suitable materials as are known in the necktie arts.

FIG. 1 illustrates a side perspective view of preferred pocket t-shirt 10 with tie pocket 11 sewn to the upper left breast portion of shirt 12. While the method of attachment is not intended to be limiting, sewing is preferred to other attachment methods such as adhesives or the like. FIG. 2 pictures a front plan view of shirt 12 with tie pocket 11 exploded therefrom. As shown, tie pocket 11 is preferable configured to resemble the bottom four to five inches (4-5") of conventional necktie 13 defining a triangular or V-shape. Preferably, tie pocket 11 is formed from the bottom four and three-quarters of an inch (4.75") of a necktie, as measured from the tip of the wide end of a conventional necktie. Although not shown, an embodiment of tie pocket 11 includes a backing material different than shirt 12, an embodiment of which may or may not be the same as tie pocket 11. While not discussed in detail, it is understood that one of ordinary skill in the art would possess sufficient sewing skills to finish the top edge of pocket 11 in the event an actual necktie was cut to form tie pocket 11, for example to prevent unraveling of the necktie and backing fabrics.

FIG. 3 demonstrates the flexibility of pocket t-shirt 10 with the various tie pocket 11 designs, including, but not limited to horizontal lines, vertical lines, geometric shapes, madras, flannel, crests, athletic team logos, school logos, and the like. Similarly, shirt 12 is represented as a white, t-shirt but embodiments may also include any desirable color. An alternate embodiment of pocket t-shirt (not shown) includes shirt 12 with a pocket formed from the same material as that which forms the shirt, adorned at the top edge with a portion of a pre-tied bow tie opposed to a neck tie. This alternate embodiment of the pocket t-shirt may define a more squared bottom compared to the V-shaped tie pocket 11 as previously discussed.

The illustrations and examples provided herein are for explanatory purposes and are not intended to limit the scope of the appended claims. Many modifications and other embodiments of the invention will come to mind of those skilled in the relevant art to which this invention pertains, and which are intended to be and are covered by both this disclosure and the appended claims. It is indeed intended that the scope of the instant invention should be determined by proper interpretation and construction of the appended claims and their legal equivalents, as understood by those of skill in the art relying upon the disclosure in this specification and the attached figures.

I claim:

1. A method of forming a pocket t-shirt comprising the steps of:

providing a necktie formed from silk micro-fiber having opposing narrow and wide ends;

forming a V-shaped pocket defining a length of less than five inches (5.0") derived cutting the wide end portion of the necktie;

providing a cotton t-shirt;

positioning the V-shaped pocket on an upper left portion of the t-shirt; and sewing the V-shaped pocket to the t-shirt along opposing side edges and both legs of the V-shaped edges; finishing a top edge of the V-shaped pocket that is unattached to the t-shirt.

2. The method of claim 1 includes attaching a backing material to the V-shaped pocket.

3. The method of claim 1 includes choosing the t-shirt from a different material color than that of the necktie.

* * * * *